US007178636B2

(12) United States Patent
Kato et al.

(10) Patent No.: US 7,178,636 B2
(45) Date of Patent: Feb. 20, 2007

(54) ELEVATOR SYSTEM

(75) Inventors: Kunio Kato, Tokyo (JP); Kazuhiro Yoshikawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 343 days.

(21) Appl. No.: 10/395,889

(22) Filed: Mar. 25, 2003

(65) Prior Publication Data

US 2004/0188183 A1 Sep. 30, 2004

(51) Int. Cl.
*B66B 11/08* (2006.01)
*B66B 9/02* (2006.01)
*B66B 5/00* (2006.01)

(52) U.S. Cl. ..... 187/254; 187/250; 187/265; 187/345

(58) Field of Classification Search ..... 187/197, 187/250, 251, 254, 266, 345, 401; 248/576, 248/605, 610, 638, 676, 562; 254/414
See application file for complete search history.

(56) References Cited

U.S. PATENT DOCUMENTS

| | | | | |
|---|---|---|---|---|
| 657,380 | A * | 9/1900 | Baldwin et al. | 187/265 |
| 1,906,665 | A * | 5/1933 | Ticknor | 254/414 |
| 2,701,032 | A | 2/1955 | Senn | |
| 3,174,585 | A * | 3/1965 | Tofanelli | 187/264 |
| 3,882,968 | A * | 5/1975 | Suozzo | 187/264 |
| 4,230,205 | A * | 10/1980 | Darwent | 187/265 |
| 5,469,937 | A * | 11/1995 | Hakala et al. | 187/266 |
| 5,899,301 | A | 5/1999 | Aulanko et al. | |
| 6,247,557 | B1 | 6/2001 | Kobayashi et al. | |
| 6,574,997 | B1 * | 6/2003 | Mayer et al. | 68/23.1 |
| 6,655,500 | B2 * | 12/2003 | Orrman et al. | 187/254 |

FOREIGN PATENT DOCUMENTS

| | | | |
|---|---|---|---|
| EP | 710618 A2 | * | 5/1996 |
| EP | 719 724 | | 11/2000 |
| EP | 1 380 530 | | 1/2004 |
| JP | 59-54474 U | | 4/1984 |
| JP | 59-054474 U | * | 4/1984 |
| JP | 7-10437 | | 1/1995 |
| JP | 2777340 | | 2/1996 |
| JP | 8-208152 | | 8/1996 |

(Continued)

*Primary Examiner*—Eileen D. Lillis
*Assistant Examiner*—Eric E. Pico
(74) *Attorney, Agent, or Firm*—Leydig, Voit & Mayer, Ltd.

(57) ABSTRACT

A hoisting machine is interposed between a wall of a hoistway and a car when viewed in a horizontally-projected perspective, and a drive sheave is located opposite the wall of the hoistway. Vibration prevention members are located between the hoisting machine and a mount member attached to fixing members in the hoistway. The vibration prevention members are located at surfaces of upper and lower portions of the mount member facing the hoisting machine, supporting the hoisting machine on the mount member from underside. As a result, vibration control of the hoisting machine can be readily achieved, and the torque acting on the hoisting machine is supported by horizontal rigidity of the vibration prevention member. Consequently, the hoisting machine can be attached to the mount member without failure. Vibration and noise, which would arise during operation of an elevator in a hoistway of a building, is reduced, thereby making the environment of the elevator silent.

6 Claims, 6 Drawing Sheets

FOREIGN PATENT DOCUMENTS

| | | |
|---|---|---|
| JP | 2877745 | 10/1996 |
| JP | 9-278310 | 10/1997 |
| JP | 11-130365 | 5/1999 |
| JP | 11-310372 | 11/1999 |
| JP | 2000-026041 | 1/2000 |
| JP | 2000-44146 | 2/2000 |
| JP | 2000-86126 | 3/2000 |
| JP | 2000-118912 | 4/2000 |
| JP | 2000-247557 | 9/2000 |
| JP | 2001-19316 | 1/2001 |
| JP | 2001-335254 | 12/2001 |
| JP | 2002-87742 | 3/2002 |
| WO | WO 99/16694 | 4/1999 |
| WO | WO 02/079068 | 10/2002 |

* cited by examiner

ELEVATOR SYSTEM

BACKGROUND OF THE INVENTION

1. Field of the Invention

The invention relates to an elevator system, wherein a hoisting machine is disposed in a hoistway and a car is vertically operated by way of a main cable passed around the hoisting machine.

2. Background Art

In a conventional elevator system, a vibration prevention member formed from vibration prevention rubber is placed on a machine table disposed in a machine room, and the hoisting machine is installed on the vibration prevention member. Thus, the hoisting machine is supported in a vibration-controlled manner, thereby preventing transmission of vibration and noise developing in the hoisting machine.

Installation of the hoisting machine in the conventional elevator system having such a construction presents difficulty in achieving required vibration control operation. Specifically, when a side surface of a drive sheave is placed so as to oppose a wall of the hoistway of the elevator system and when the hoisting machine is positioned between the wall of the hoistway and an elevater-car, as viewed in horizontally-projected perspective, installation of the vibration prevention member having the foregoing structure cannot be adopted, and therefore vibration control effect is insufficient.

The present invention has been conceived to solve the problem and provides an elevator system which enables easy achievement of required vibration control effect with a construction in which a hoisting machine is installed in a hoistway and a drive sheave opposes a wall of the hoistway.

SUMMARY OF THE INVENTION

According to one aspect of the present invention, an elevator system comprises a hoisting machine, a mount member and a plurality of vibration prevention members. The hoisting machine is disposed within a hoistway between a wall of the hoistway and a car when viewed in horizontally-projected perspective, and the hoisting machine has a drive sheave around which a main cable is passed. The mount member is disposed so as to correspond to the hoisting machine and attached to fixing members provided in the hoistway. A plurality of vibration prevention members is provided between the hoisting machine and the mount member. One end of the vibration prevention member is supported by the mount member, preferably at the lower side of the support section of the mount member. Other end of the vibration prevention member is located at a position of the hoisting machine opposing the mount member, preferably on the mount section of the hoisting machine. Thus, the vibration prevention member is disposed to be compressed by upwardly-oriented load acting on the drive sheave.

In another aspect of the invention, in the elevator system, the vibration prevention member is preferably provided on a lower portion of the mount member and is compressed by upwardly-oriented load acting on the drive sheave.

In another aspect of the invention, in the elevator system, the vibration member is preferably interposed between support section of the mount member and mount section of the hoisting machine located on the lower sides of the support sections.

In another aspect of the invention, in the elevator system, the vibration prevention members preferably include four members that are respectively provided at both ends of upper and lower surfaces of the hoisting machine opposing the mount member.

In another aspect of the invention, in the elevator system, the mount member is preferably attached to upper portions of fixing members provided upright on the bottom of the hoistway.

In another aspect of the invention, in the elevator system, securing member is preferably attached to the fixing members provided upright on the bottom of the hoistway, and the securing member is secured to the wall of the hoistway.

Other and further objects, features and advantages of the invention will appear more fully from the following description.

DETAILED DESCRIPTION OF THE PREFERRED EMBODIMENTS

Figure 1:
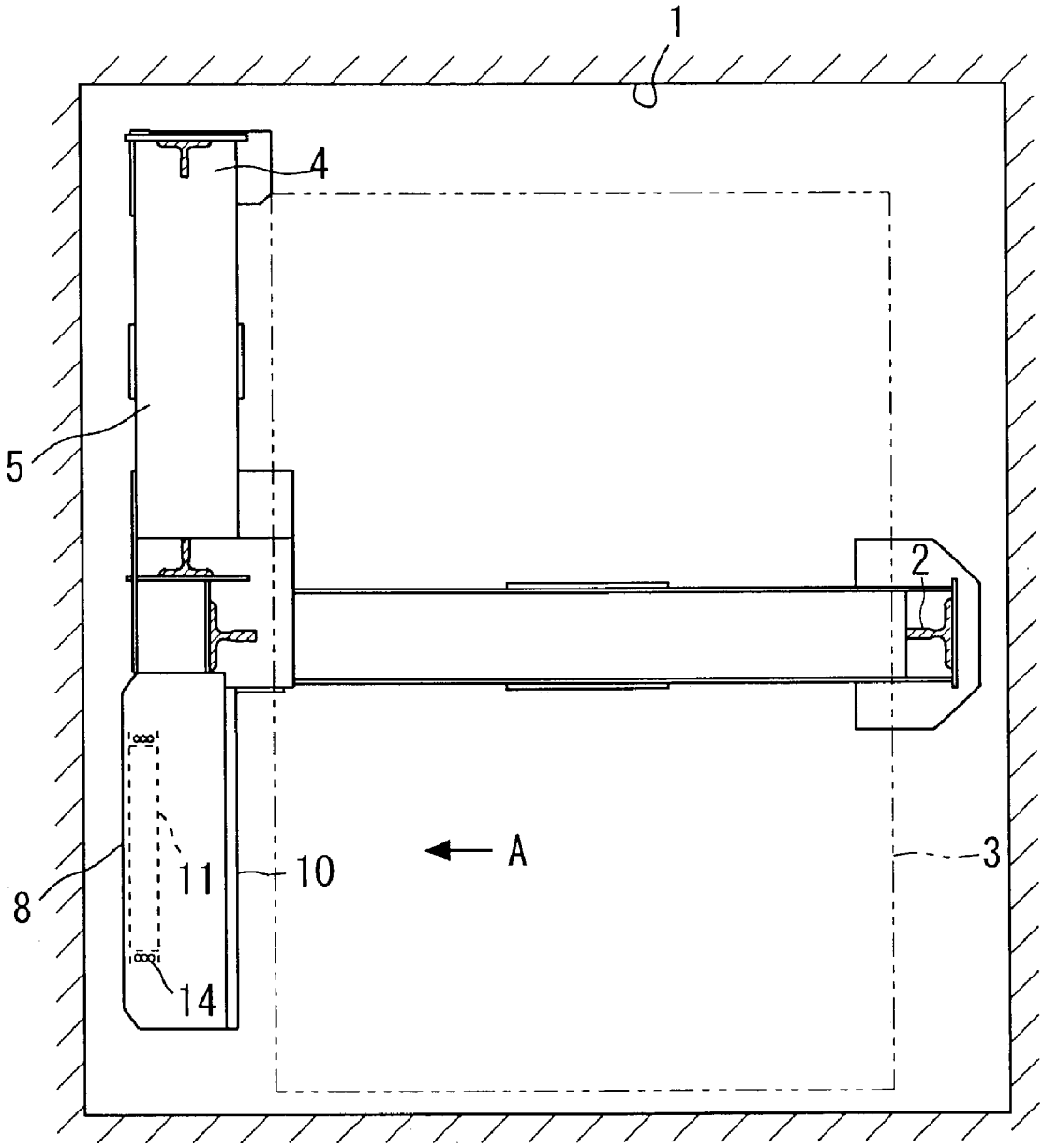
FIG. 1 is a transverse plan view of a hoistway or a elevator shaft of an elevator system in the present invention.
Figure 2:
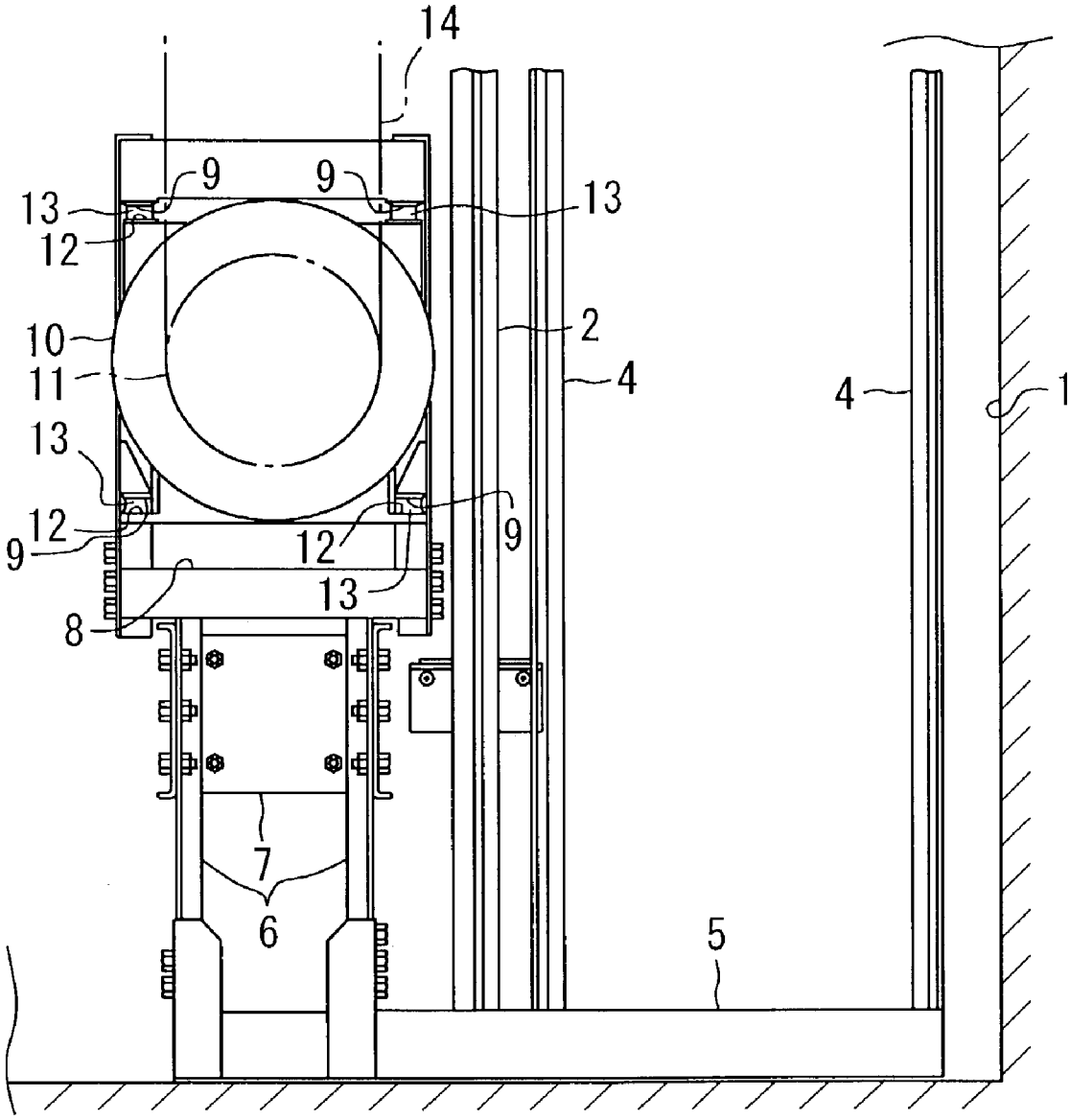
FIG. 2 is a front view when viewed in the direction of the arrow A in FIG. 1.
Figure 3:
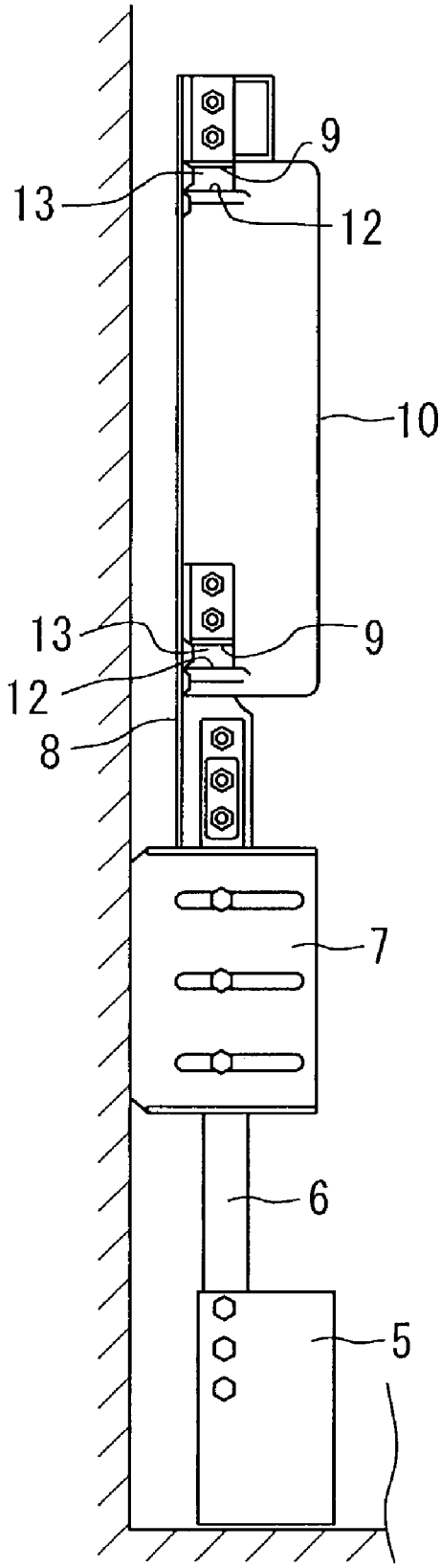
FIG. 3 is a left side view of FIG. 2.
Figure 4:
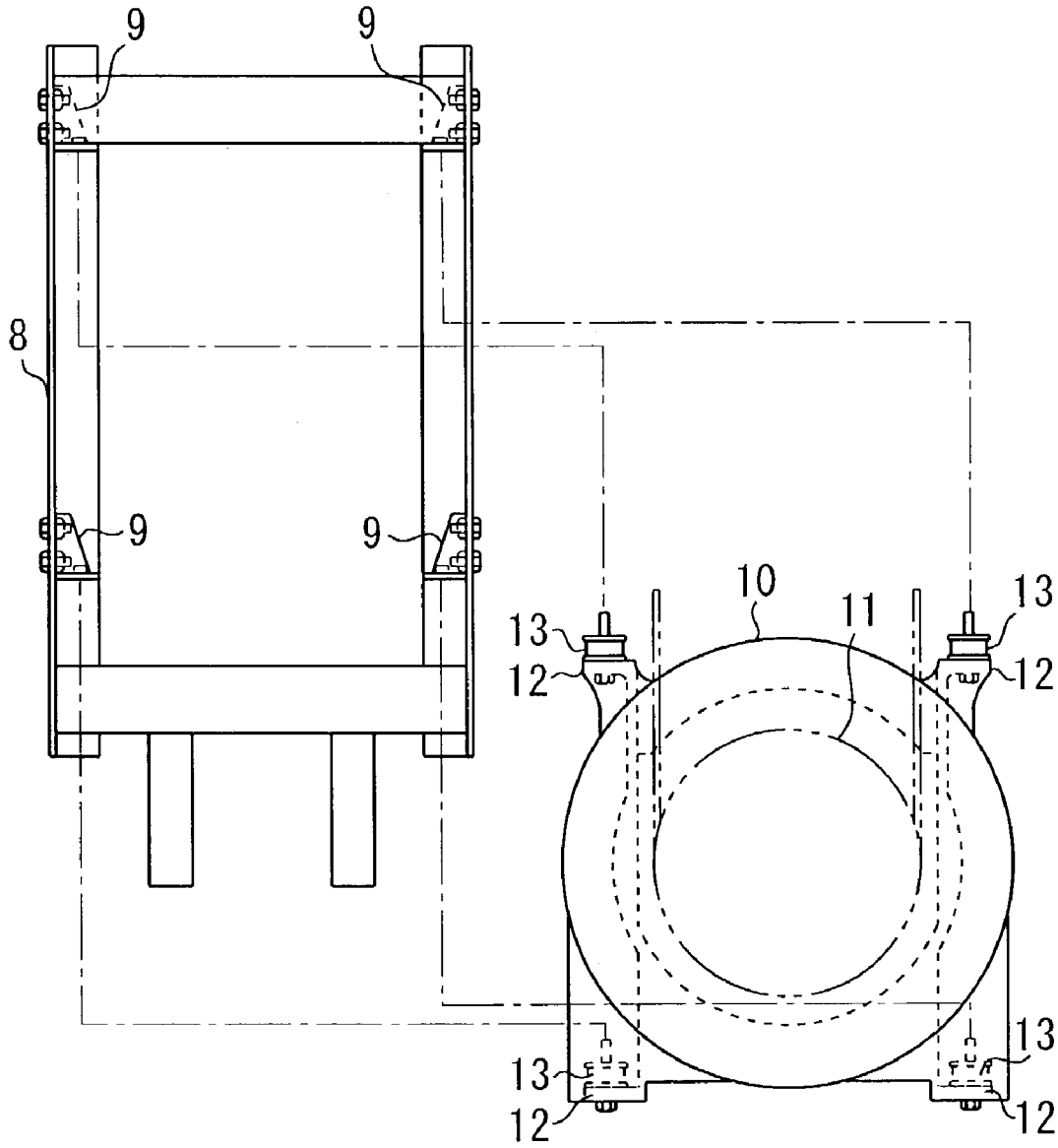
FIG. 4 is a front view of a hoisting machine and a mount member shown in a separated way.
Figure 5:
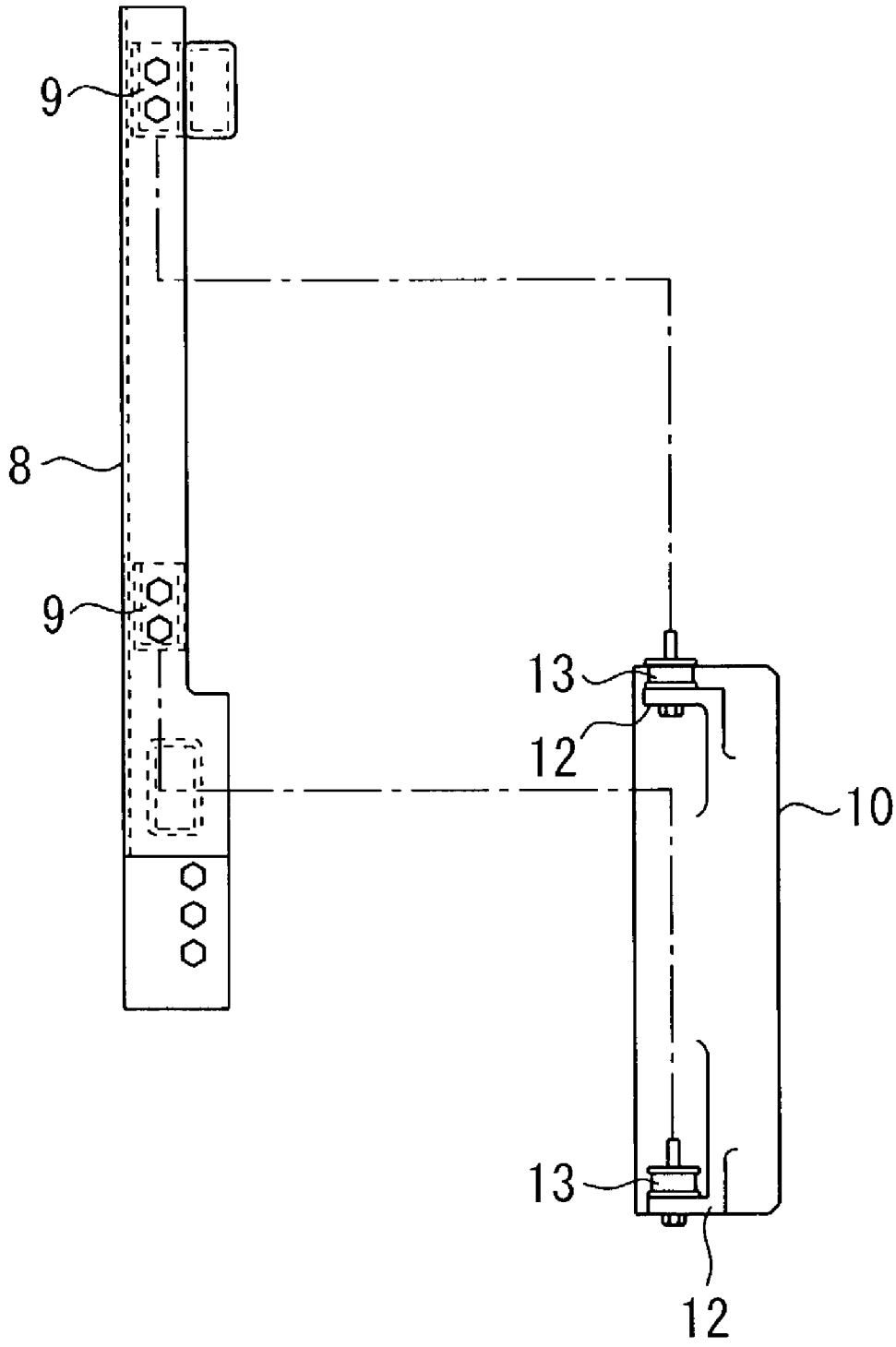
FIG. 5 is a left side view of FIG. 4.
Figure 6:
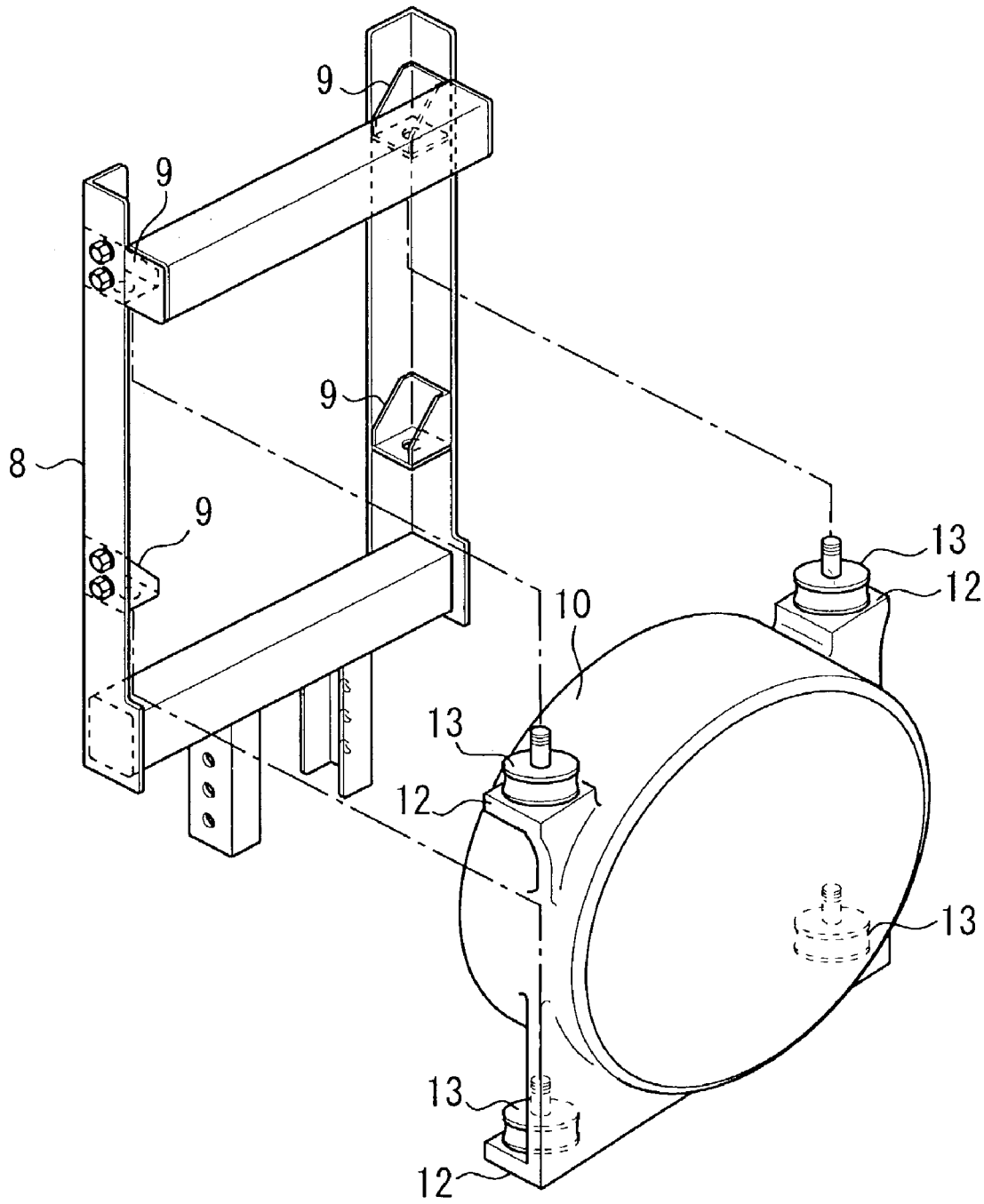
FIG. 6 is a perspective view of a hoisting machine and a mount member shown in a separated way.

FIGS. 1 through 6 show an embodiment of the present invention. FIG. 1 is a transverse plan view of a hoistway or a shaft in an elevator system according to the present invention; FIG. 2 is a front view when viewed in the direction of the arrow A in FIG. 1; and FIG. 3 is a left side view of FIG. 2. Further, FIG. 4 is a front view of a hoisting machine and a mount member shown in a separated way; FIG. 5 is a left side view of FIG. 4; and FIG. 6 is a perspective view of a hoisting machine and a mount member shown in a separated way.

As shown in the drawings, in a hoistway 1 for an elevator, a pair of car rails 2 is provided upright and spaced apart from each other, and a car 3 is provided between the car rails 2. A pair of counterweight rails 4 is provided upright within the hoistway 1 and spaced apart from each other.

A buffer mount 5 is placed on the bottom floor of the hoistway 1 corresponding to a counterweight, not shown, placed between the counterweight rails 4. A pair of fixing members 6 is formed from two pillars provided upright on the buffer mount 5. Upper ends of the fixing members 6 are linked together and secured on the wall of the hoistway 1 by means of a securing member 7.

A mount member 8 is fastened to the upper ends of the fixing members 6. The mount member 8 is formed from a frame member, and is made by assembling a steel product into a hollow square shape. Support sections 9 are attached to respective upper and lower ends of the mount member 8. Preferably, four support sections 9 are provided close to four inner corners of the mount member 8 as clearly seen in FIG. 4 or FIG. 6.

A hoisting machine 10 has a drive sheave 11 and is held in a housing. Four mount sections 12 are provided on the housing so as to correspond to the respective support sections 9 of the mount member 8. The hoisting machine 10 is placed close to the mount member 8, and each of the mount sections 12 is placed to oppose to a lower side of the respective support section 9.

Each of vibration prevention members 13 is interposed between the support section 9 of the mount member 8 and the mount section 12 of the hoisting machine 10 respectively. The vibration prevention member 13 is preferably formed from vibration prevention rubber. Each of the mount sections 12 comes close to each of the support sections 9 from under side of the support sections 9. The support section 9 and the mount section 12 are connected via a vibration prevention member 13 in between. Thus, the hoisting machine 10 is connected to the mount member 8 with its drive sheave 11 opposed to the mount member 8.

A main cable 14 is passed around the drive sheave 11. Although omitted from the drawings, one end of the main cable 14 is passed around a pulley, which is rotatably attached to the top of the hoistway 1, and is connected to a car 3. The other end of the main cable 14 is passed around another pulley, which is rotatably attached to the top of the hoistway 1, and is connected to a counterweight not shown.

In the elevator system having the foregoing construction, the hoisting machine 10 is placed between the wall of the hoistway 1 and the car 3, and the front surface of the drive sheave 11 is placed so as to oppose the wall of the hoistway 1. The hoisting machine 10 is supported within the hoistway 1 by means of the mount member 8 via the vibration prevention members 13 placed on the mount sections 12 provided at the four corners of the hoisting machine 10.

By means of, such a construction, the hoisting machine 10 is supported within the hoistway 1 through the vibration prevention members 13. The vibration prevention members 13 are compressed by upwardly-oriented load acting on the hoisting machine 10, thereby yielding vibration control effect. Further, the torque exerted on the hoisting machine 10 is supported by horizontal rigidity of the vibration prevention members 13. Consequently, the hoisting machine 10 is supported on the mount member 8 without involvement of any failure. The required effect for controlling vibration of the hoisting machine 10, which would be yielded by the vibration prevention members 13, is readily achieved. As a result, noise or vibration, which is inducted at the time of operation of the elevator installed in a building having the hoistway 1 provided therein, can be eliminated.

In the embodiment shown in FIGS. 1 through 6, four vibration prevention members 13 are provided at the upper and lower ends of the housing of the hoisting machine 10. Therefore, the vibration prevention members 13 can be made compact, thereby curtailing the space required to install the hoisting machine 10. Consequently, the space required to construct the hoistway 1 is reduced, thereby curtailing the cost for installing the elevator system.

In the embodiment shown in FIGS. 1 through 6, the mount member 8 is formed from a frame member and has a rectangular hollow shape. The vibration prevention members 13 are placed at four corners within the frame of the mount members 8. Therefore, the load of the hoisting machine 10 can be supported by the mount member 8 which is formed from the minimum number of structure members. Consequently, the space required to install the hoisting machine 10 can be reduced, and hence the space required to form the hoistway 1 is reduced, thereby lowering the cost for constructing the elevator system.

In the embodiment shown in FIGS. 1 through 6, the mount member 8 is provided on the fixing members 6 provided upright on the buffer mount 5. Therefore, upwardly-oriented load acting on the hoisting machine 10 is transmitted to the buffer mount 5. On the other hand, downwardly-oriented load acts on the counterweight rails 4 by way of the counterweight-side pulley provided on the counterweight rails 4 standing upright on the buffer mount 5 and around which the main cable 14 is passed. Therefore, the load acting on the counterweight rails 4 cancels the upwardly-oriented load acting on the buffer mount 5.

Consequently, the mount member 8 can be provided without a necessity for a special member for supporting the mount member 8 on the wall of the hoistway 1. As a result, the mount member 8 can be readily provided in the hoistway 1, thereby curtailing the cost for manufacturing and installing the mount member 8.

In the embodiment shown in FIGS. 1 through 6, the securing member 7 is connected to the fixing members 6 and secured to the wall of the hoistway 1, so that the fixing members 6 are secured to the wall of the hoistway 1 via the securing hardware 1. Therefore, during an installation operation of the elevator system, any load to be lifted can be supported by only the securing member 7. Thus, various components of the elevator system may be lifted by use of the hoisting machine 10 used as a winch. Hence, the efficiency of installation operation is improved, thereby curtailing installation costs.

In the embodiment shown in FIGS. 1 through 6, the securing member 7 is attached to the fixing members 6, and the fixing members 6 are secured on the wall of the hoistway 1 by way of the securing member 7. Hence, the fixing members 6, although formed from two pillars, may be prevented from rolling or swaying. Thus, the structure of the fixing members 6 can be simplified, thereby reducing construction costs.

In the embodiment shown in FIGS. 1 through 6, the mount member 8 is placed on and connected to the fixing members 6 provided upright on the buffer mount 5. Usually a pit depth is varied in accordance with the speed of the elevator. When a pit depth is varied, the fixing members 6 may be manufactured so as to assume a height corresponding to the pit depth by means of the foregoing simple construction. The hoisting machine 10 may be installed by combination of the mount member 8 and the fixing members 6 previously prepared corresponding to the pit depth. As a result, manufacturing costs can be curtailed.

The features and the advantages of the present invention may be summarized as follows.

According to one aspect of the present invention, an elevator system comprises a hoisting machine, a mount member and a plurality of vibration prevention members. The hoisting machine is disposed within a hoistway between a wall of the hoistway and a car when viewed in horizontally-projected perspective, and the hoisting machine has a drive sheave around which a main cable is passed. The mount member is disposed so as to correspond to the hoisting machine and attached to fixing members provided in the hoistway. A plurality of vibration prevention members is provided between the hoisting machine and the mount member. One end of the vibration prevention member is supported by the mount member, preferably at the lower side of the support section of the mount member. Other end of the vibration prevention member is located at a position of the hoisting machine opposing the mount member, preferably on the mount section of the hoisting machine. Thus, the vibration prevention member is disposed to be compressed by upwardly-oriented load acting on the drive sheave.

As a result, the hoisting machine is placed between the wall of the hoistway and the car when viewed in horizontally-projected perspective, and the drive sheave is placed so as to oppose the wall of the hoistway. By means of the vibration prevention members placed on the upper and lower sections on the surface of the mount frame facing the hoisting machine, the hoisting machine is fixedly supported within the hoistway. The effect of controlling vibration yielded by the vibration prevention members is achieved, and the torque acting on the hoisting machine is supported by the horizontal rigidity of the vibration prevention member. Consequently, the hoisting machine is supported on the mount member without failure. Further, the required vibration control effect of the vibration prevention member is readily achieved. Noise and vibration, which arise during operation of an elevator in a building where the hoistway is installed, are diminished, thereby rendering an environment silent.

In another aspect of the invention, in the elevator system, the vibration prevention member is preferably provided on a lower portion of the mount member and is compressed by upwardly-oriented load acting on the drive sheave.

As a result, the vibration prevention member can be made compact, thereby reducing the space required to install the hoisting machine. The space required to construct a hoistway is reduced, thereby yielding an effect for curtailing the cost of installing an elevator system.

In another aspect of the invention, in the elevator system, the vibration member is preferably interposed between support section of the mount member and mount section of the hoisting machine located on the lower sides of the support sections.

As a result, the load acting on the hoisting machine can be supported by means of the mount member formed from the minimum number of members. Consequently, the space required to install the hoisting machine can be reduced, and the space required to construct a hoistway is diminished, thereby yielding an effect for curtailing the cost of installing an elevator system.

In another aspect of the invention, in the elevator system, the vibration prevention members preferably include four members that are respectively provided at both ends of upper and lower surfaces of the hoisting machine opposing the mount member.

Although the upwardly-oriented load acting on the hoisting machine is transmitted to the buffer mount, the upwardly-oriented load acting on the buffer mount is cancelled by the load which acts on the counter weight rails provided upright on the buffer mount by way of a counterweight pulley around which the main cable is passed. Consequently, a mount member can be placed without involvement of a necessity for a special member for supporting the mount member on the wall of the hoistway. Therefore, the mount member can be readily placed in the hoistway, thereby yielding an effect of reducing the cost for manufacturing and installing the mount member.

In another aspect of the invention, in the elevator system, the mount member is preferably attached to upper portions of fixing members provided upright on the bottom of the hoistway.

In relation to a variation in the pit depth of a hoistway, which is set in accordance with the speed of an elevator, fixing members are manufactured so as to assume a height corresponding to the pit depth by means of the foregoing construction. A hoisting machine is installed by combination of the mount member and the fixing members of given height previously-prepared corresponding to the pit depth. As a result, there is yielded an advantage of the ability to curtail manufacturing costs.

In another aspect of the invention, in the elevator system, securing member is preferably attached to the fixing members provided upright on the bottom of the hoistway, and the securing member is secured to the wall of the hoistway.

As a result, instruments of the elevator system are lifted by use of the hoisting machine used as a winch during an installation operation, load to be lifted can be supported by only the securing member. Hence, there is yielded an advantage of the ability to curtail installation costs by improving the efficiency of installation operation.

Obviously many modifications and variations of the present invention are possible in the light of the above teachings. It is therefore to be understood that within the scope of the appended claims the invention may by practiced otherwise than as specifically described.

The entire disclosure of a Japanese Patent Application No. 2000-282966, filed on Mar. 11, 2000 including specification, claims, drawings and summary are incorporated herein by reference in its entirety.

The invention claimed is:

1. An elevator system comprising:

a hoisting machine disposed within a hoistway between a wall of the hoistway and a car moving within the hoistway, the hoisting machine including a driven sheave rotating about an axis and around which a main cable passes for moving the car;

fixing members located in the hoistway;

a mount member attached to the fixing members; and at least two vibration prevention members disposed in a plane transverse to the axis of the driven sheave and on opposite sides of the axis of the driven sheave, at least a first of the vibration prevention members being located at an upper side of the driven sheave above the axis of the driven sheave in the hoistway, and at least a second of the vibration prevention members being located at a lower side of the driven sheave, below the axis of the driven sheave in the hoistway, at least one of the first and second vibration prevention members having an upper end connected to the mount member and a lower end bearing on the hoisting machine, mounting the hoisting machine to the mount member, at least one of the first and second vibration prevention members being compressed by an upwardly oriented load acting on the driven sheave.

2. The elevator system according to claim 1, wherein each of the vibration prevention members is located under a respective support section of the mount member and interposed between a respective support section of the mount member and a respective mount section of the hoisting machine.

3. The elevator system according to claim 1, including two pairs of the vibration prevention members, one pair of the vibration prevention members being located at each of the upper and lower sides of the driven sheave, facing the mount member, all of the vibration prevention members being compressed by an upwardly oriented load acting on the driven sheave.

4. The elevator system according to claim 1, wherein the mount member is attached to upper portions of the fixing members, the fixing members being upright at a bottom of the hoistway.

5. The elevator system according to claim 1, including a securing member attached to the fixing members, the fixing members being upright on a bottom of the hoistway, the securing member being secured to the wall of the hoistway.

6. The elevator system according to claim 1, wherein the mount member comprises a frame having a rectangular shape and including support sections supporting the hoisting machine and located at upper and lower portions of the mount member.

* * * * *